US007044868B2

(12) United States Patent
Brine et al.

(10) Patent No.: US 7,044,868 B2
(45) Date of Patent: May 16, 2006

(54) ENERGY ABSORBING LACROSSE HEAD CONSTRUCTION

(75) Inventors: Erik Brine, Upton, MA (US); Kyle Lamson, Chelmsford, MA (US)

(73) Assignee: Brine, Inc., Milford, MA (US)

( * ) Notice: Subject to any disclaimer, the term of this patent is extended or adjusted under 35 U.S.C. 154(b) by 0 days.

(21) Appl. No.: 10/155,267

(22) Filed: May 24, 2002

(65) Prior Publication Data

US 2004/0224798 A1 Nov. 11, 2004

(51) Int. Cl.
*A63B 59/02* (2006.01)
*A63B 65/12* (2006.01)

(52) U.S. Cl. ..... 473/513; D21/724

(58) Field of Classification Search ..... 473/512, 473/513, 514, 528, 543, 505; D21/724
See application file for complete search history.

(56) References Cited

U.S. PATENT DOCUMENTS 3,507,495 A * 4/1970 Tucker et al. ..... 473/513
4,034,984 A * 7/1977 Crawford et al. ..... 473/513
4,097,046 A * 6/1978 Friant ..... 473/513
4,138,111 A * 2/1979 Rule ..... 473/513
4,270,756 A * 6/1981 Ahlenfeld et al. ..... 473/513
5,082,290 A * 1/1992 Tucker et al. ..... 473/513
5,174,580 A * 12/1992 Pratt ..... 473/513
5,178,397 A * 1/1993 Brine, Jr. ..... 473/513
5,568,925 A * 10/1996 Morrow et al. ..... 473/513
5,951,504 A * 9/1999 Iglesias et al. ..... 602/27
5,957,791 A * 9/1999 Nichols et al. ..... 473/513

FOREIGN PATENT DOCUMENTS

GB 424742 * 2/1935

OTHER PUBLICATIONS

Great Atlantic Lacrosse Company Catalog, Oct. 2001-9 pages.*

* cited by examiner

*Primary Examiner*—Eugene Kim
*Assistant Examiner*—M. Chambers
(74) *Attorney, Agent, or Firm*—Mirick, O'Connell, DeMallie & Lougee, LLP

(57) ABSTRACT

A lacrosse head construction comprising a frame comprising a forward scoop having a width, a rearward wall more narrow than the scoop width and two opposing sidewalls between the scoop and the rearward wall; wherein at least a portion of each sidewall comprises a material that is softer than the material of at least the scoop, to create sidewalls that help to dampen movement of a lacrosse ball into or within the lacrosse head.

7 Claims, 6 Drawing Sheets

ENERGY ABSORBING LACROSSE HEAD CONSTRUCTION

FIELD OF THE INVENTION

This invention relates to a lacrosse head.

BACKGROUND OF THE INVENTION

Lacrosse heads are typically one piece molded structures made of a plastic material having requisite stiffness and toughness properties. A material in common use is a super-tough nylon material.

In the game of lacrosse, the skills of catching the ball and retaining the ball in the stick are critical. However, to some extent these are competing aims. In order to make catching the ball easier, it is desirable to have the front side of the head that receives the ball as open as possible. This increases the catching area of the head. However, in order to assist in maintaining the ball in the head, it is desirable to have a minimal front area that presents less opportunity for the ball to inadvertently leave the head, commonly caused by checking of the stick by an opponent.

Attempts to balance these two needs have met with limited success. Lacrosse heads generally have an approximate "V" shape, with the sidewalls generally diverging from the rearward throat portion where the head is attached to the shaft, up to the widened scoop portion. When a ball resides in the head, it is carried in the netting at a location which is usually relatively close to the narrower throat portion of the head. Consequently, one attempt at a solution to the problems described above has been to narrow the head (decrease the distance between the sidewalls) in the lower portion of the head in which the ball resides when it is carried by a lacrosse player. This presents less open area from which the ball may leave the head just above where the ball will likely reside when it is being carried. This to some extent does increase retention of the ball. However, at the same time, these pinched sidewall heads present substantially less open area in the lower portion of the head, making catching the ball more difficult. Highly skilled players can manipulate these pinched sidewall heads appropriately so that they catch the ball typically higher in the head closer to the scoop where the head is wider and thus there is more area for the ball to enter the head. Players without finely developed skills, however, find that the ball is much harder to catch with these pinched sidewall heads as there is, in sum, less open area through which the ball can enter the head. And, since the ball must be caught before it is carried, the pinched sidewalls in many cases actually result in less ball control than a standard head.

Another attempted solution to these problems has been to maintain a standard distance between the sidewalls in the lower portion of the head at the top rim of the sidewalls where the ball enters the head, and move the lower portion of the sidewalls in the same area of the head closer together, to narrow the pocket region in which the ball is carried. This results in the inner surface of the sidewalls being angled towards one another from the top rim to the bottom rim. Although this design does maintain a relatively large catch area and a relatively smaller open area in the pocket region of the head, it is believed that the angled interior sidewall portions present more opportunity for the ball to bounce erratically off the sidewall as it is being caught and/or carried. Such heads thus require that the user ideally catch the ball directly in the center of the head or face the open side of the head directly at an incoming ball in order to minimize unwanted ricochet from the sidewalls. Even with this, however, if the ball is close to the sidewall it will likely contact the lower part of the sidewall as it enters the head, causing an unwanted ricochet and thus more difficulty in settling the ball into the pocket. In some cases, this ricochet is sufficient to bounce the ball off the sidewall and out of the head, thus entirely defeating the catching action. These angled sidewall lacrosse heads thus increase the difficulty of the catching action in a manner similar to that described above for the pinched sidewall heads.

SUMMARY OF THE INVENTION

It is therefore an object of this invention to provide a lacrosse head construction that is easy to catch with.

It is a further object of this invention to provide such a lacrosse head construction that dampens ricochet of the ball from the sidewalls.

It is a further object of this invention to provide such a lacrosse head construction that accomplishes a narrowed pocket portion without effectively decreasing the distance between the sidewalls.

It is a further object of this invention to provide such a lacrosse head construction that accomplishes a wider catching area while also effectively narrowing the pocket so that the ball is easier to retain in the pocket.

This invention results from the realization that a lacrosse head construction that maintains a wide catch area but also effectively narrows the pocket portion can be accomplished with sidewall inserts that project partially inwards from the sidewalls and are made of a material that is softer than the material of the rest of the head and from which the pocket is strung.

This invention features a lacrosse head construction, comprising a frame comprising a forward scoop having a width, a rearward wall more narrow than the scoop width, and two opposing sidewalls between the scoop and the rearward wall; wherein at least a portion of each sidewall comprises a material that is softer than the material of at least the scoop, to create sidewalls that help to dampen movement of a lacrosse ball into or within the lacrosse head.

The scoop, rearward wall and a portion of each sidewall may comprise an integral frame member. The softer sidewall portions may comprise separate partial sidewall inserts. The inserts may be mechanically coupled to the integral frame member. The frame member may define a plurality of connection openings, and portions of each sidewall insert may be held in these openings, to mechanically couple the inserts to the frame member. The connection openings may be along the top of the frame member sidewalls. The connection openings may also be along the bottom of the frame member sidewalls. The frame member sidewalls may comprise spaced top and bottom rails, and the inserts may be coupled to one or both rails.

The frame sidewalls may each define an upper rim, and the softer sidewall portions may be at least along a portion of the sidewalls' upper rims. The frame sidewalls may each further define inside surfaces, and the softer sidewall portions may also be located at least along a portion of the sidewalls' inside surfaces.

The frame may define a plurality of stringing holes, and the softer sidewall portions may each define one or more stringing holes. The softer sidewall portions may project inward from the inside surfaces of the sidewalls to lessen the distance between the sidewalls.

Also featured is a lacrosse head construction, comprising, an integral frame member comprising a forward scoop having a width, a rearward wall more narrow than the scoop width, and two opposing sidewalls between the scoop and the rearward wall, wherein the frame sidewalls each define an upper rim; and partial sidewall inserts located at least along a portion of the sidewalls' upper rim, the partial sidewall inserts comprising a material that is softer than the material of the internal frame member, to create sidewalls that help to dampen movement of a lacrosse ball into or within the lacrosse head.

The frame sidewalls may each further define inside surfaces, and the softer sidewall portions may also be located at least along a portion of the sidewalls' inside surfaces. The frame may define a plurality of stringing holes, and the softer sidewall portions may each define one or more stringing holes. The softer sidewall portions may project inward from the sidewalls, to lessen the distance between the sidewalls.

Also featured is a lacrosse head construction, comprising an integral frame member comprising a forward scoop having a width, a rearward wall more narrow than the scoop width, and two opposing sidewalls between the scoop and the rearward wall; and partial sidewall inserts mechanically coupled to the integral frame member and located at least along a portion of the sidewalls' upper rim and projecting inward from the sidewalls to lessen the distance between the sidewalls, the partial sidewall inserts comprising a material that is softer than the material of the internal frame member, to create sidewalls that help to dampen movement of a lacrosse ball into or within the lacrosse head.

The frame sidewalls may each define an upper rim, and the partial sidewall inserts may be at least along a portion of the sidewalls' upper rim. The frame sidewalls may each further define inside surfaces, and the partial sidewall inserts may also be at least along a portion of the sidewalls' inside surfaces. The frame may define a plurality of stringing holes, and the partial sidewall inserts may each define one or more stringing holes.

BRIEF DESCRIPTION OF THE DRAWINGS

Other objects, features and advantages will occur to those skilled in the art from the following description of the preferred embodiments and the accompanying drawings, in which.

DETAILED DESCRIPTION OF THE PREFERRED EMBODIMENTS

This invention may be accomplished in a lacrosse head construction with a modified unitary frame. The frame is modified by making at least a portion of each sidewall of a material that is softer than the material of the rest of the head. This creates sidewalls that help to dampen ricochet of the ball off the head. These portions can be integral with the rest of the head (for example by insert molding), or can be attached to the frame by mechanical means and/or adhesives, for example.

Figure 1:
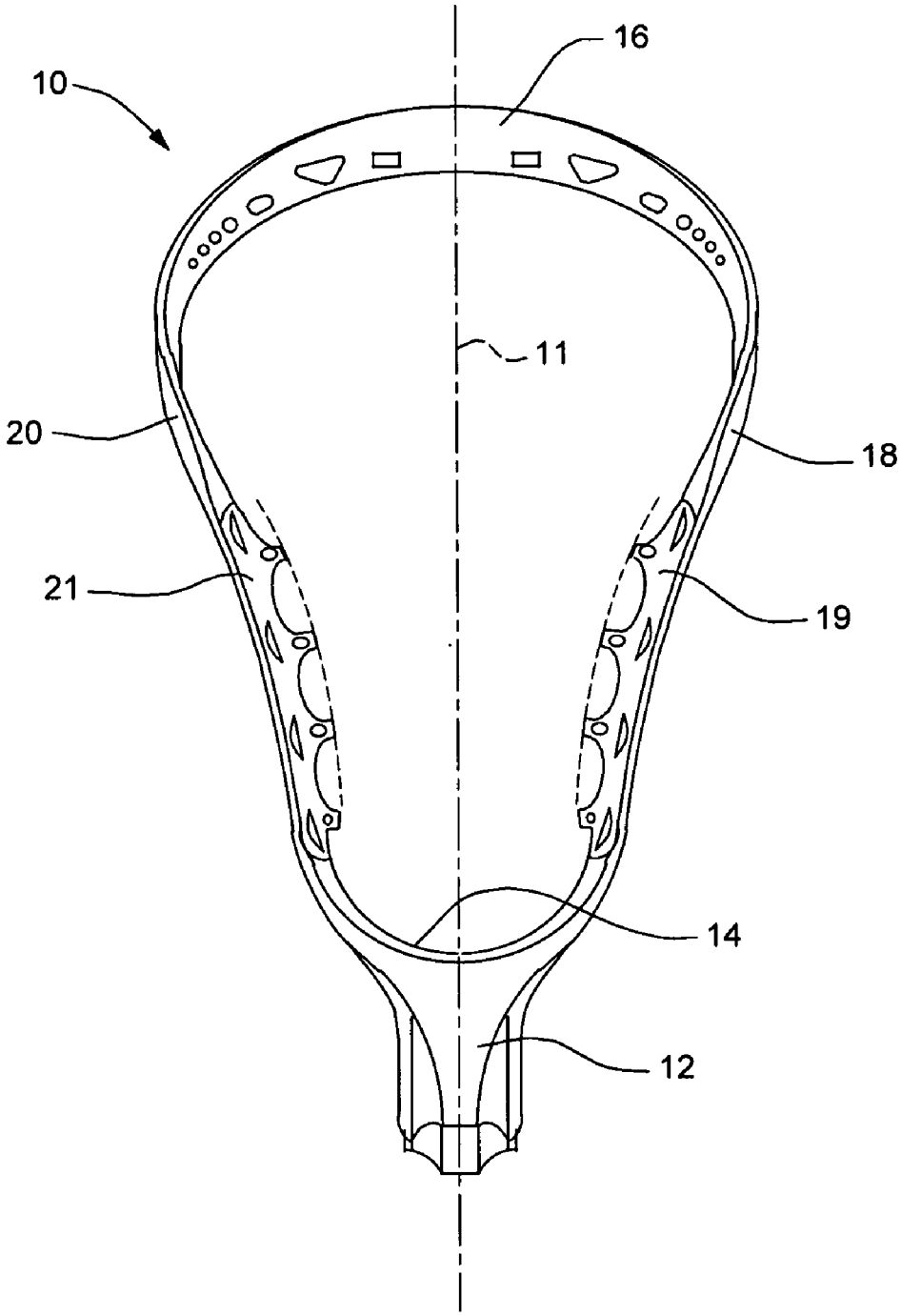
FIG. 1 is a front view of a lacrosse head construction of the invention.
Figure 2A:
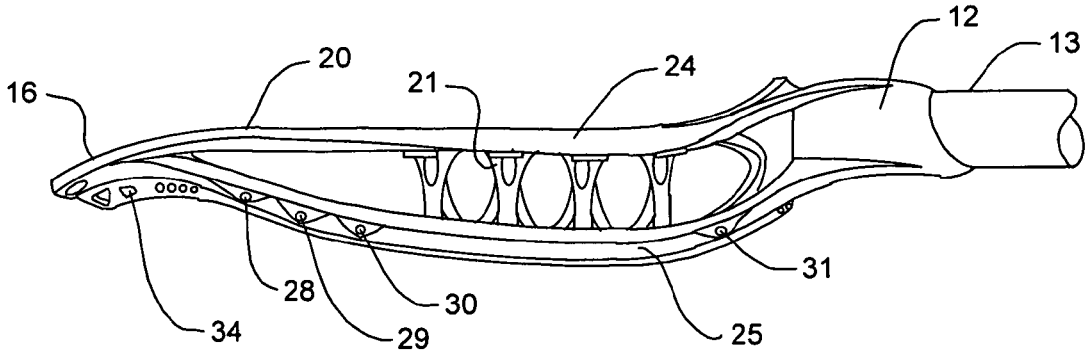
FIG. 2A is a left side view of the lacrosse head of FIG. 1.

The preferred embodiment of the invention is shown in the figures. Lacrosse head frame 10 comprises rearward wall or stop portion 14, widened forward scoop 16, and sidewalls 18 and 20 connecting wall 14 to scoop 16. As shown in the drawings, sidewalls 18 and 20 generally diverge from more narrow rearward wall 14 to wider scoop 16. This lacrosse head shape is typical. Frame 10 also includes socket 12 for receiving shaft 13, FIG. 2A.

The inventive lacrosse head construction is accomplished with at least a portion of each sidewall comprising a material that is softer than the material of at least the scoop of the lacrosse head frame. In the preferred embodiment, softer sidewall portions 19 and 21 are coupled to sidewalls 18 and 20, respectively, to accomplish the softer sidewall portions. One softer sidewall portion 21 is shown in more detail in FIGS. 2–4. In this embodiment, sidewall portion 19 is a mirror image of sidewall portion 21. This makes the lacrosse head construction bilaterally symmetric about central longitudinal axis 11.

Sidewall portions 19 and 21 in this embodiment are molded members made from a material that is softer than the material of the rest of the lacrosse head construction. In the preferred embodiment, the lacrosse head construction is accomplished with a unitary injection molded frame made from a super tough nylon material, along with softer sidewall portions made from a softer, rubbery material such as urethane. This material has a lower hardness as measured by a durometer. For example, one super tough nylon has a durometer reading of about 100 A, and this urethane material has a durometer reading of about 60 A–80 A. The flexible, rubber-like material is hard enough to hold its shape, but soft enough that it will move when impacted by a ball.

Figure 4:
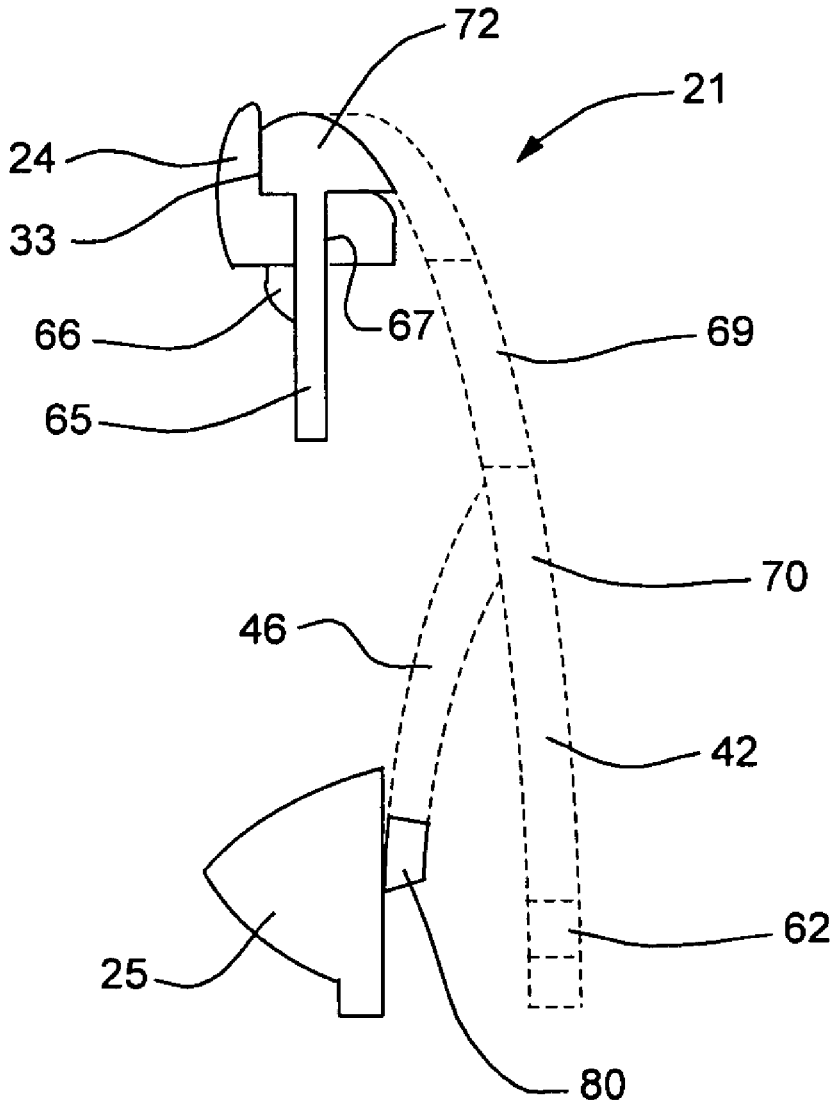
FIG. 4 is a cross sectional view of the sidewall insert of FIGS. 3A and 3B.
Figure 5:
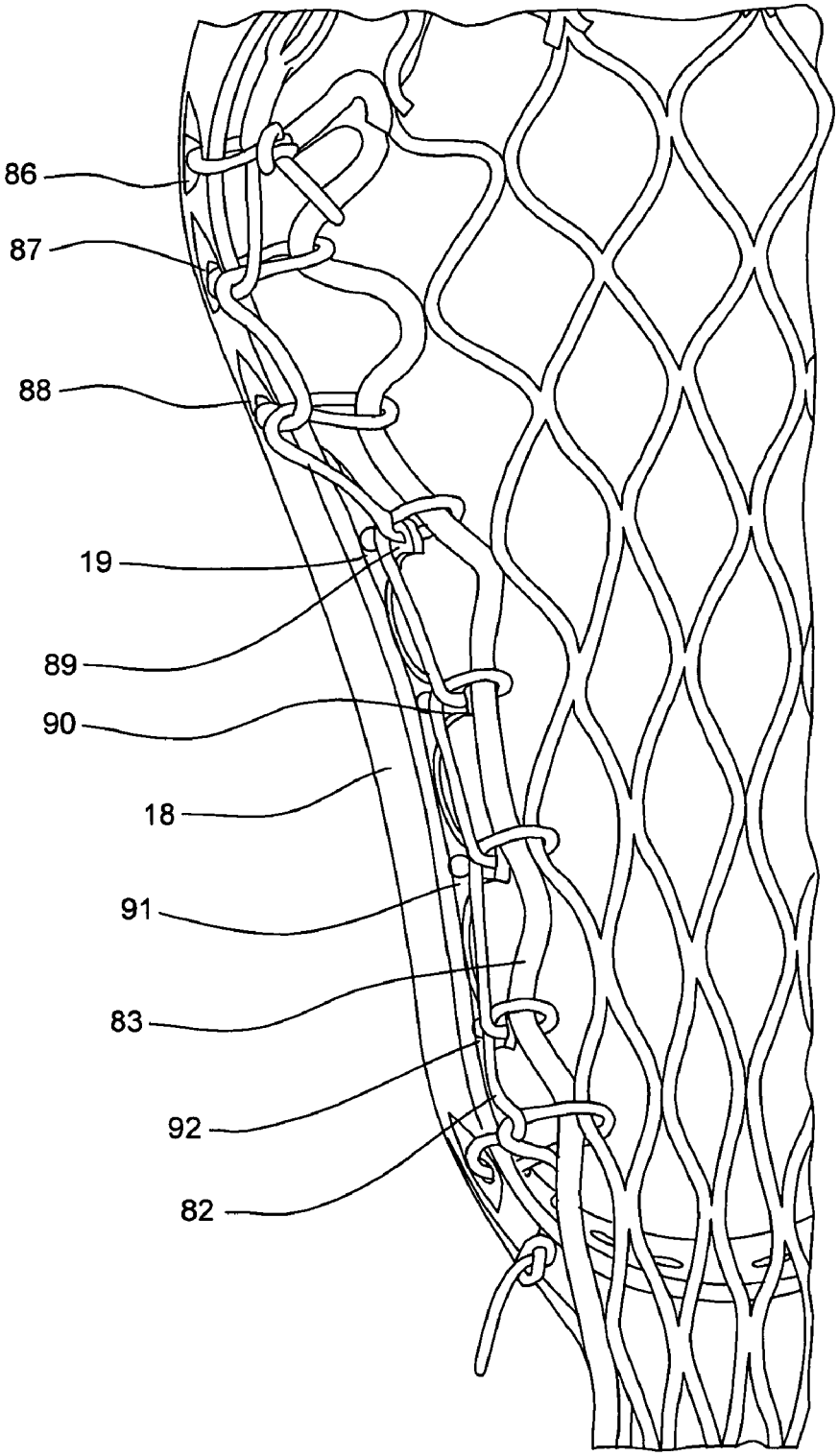
FIG. 5 is a partial bottom view of a strung lacrosse head with the softer sidewall inserts of FIG. 1.

In the preferred embodiment shown in the drawings, the softer sidewall portions extend along the entire height of the portions of the sidewalls to which they are attached. Sidewall portion 21 comprises top 40 that preferably fits into an indentation 33 in top rail 24 of sidewall 20. This arrangement accomplishes a sidewall outward facing top rim that is primarily of the softer material so that there is less ricochet from the top rim of the sidewalls. Portion 21 includes lower extending/stringing members 41–44, each defining one or more stringing holes 61–64, respectively, from which a portion of the netting is strung as shown in FIG. 5. Lower members 46, 48 and 50 provide contact areas or possible attachment areas of member 21 to lower rail 25 of sidewall 20, FIG. 4. In the preferred embodiment, members 46, 48 and 50 lie against rail 25, and maintain the inward angle of portions 41–44 as is shown in FIG. 4. Alternatively, these members could be attached to the sidewall.

This construction provides an inside surface 70 of portion 21 that extends essentially along the entire height of the sidewalls in the rearward portion of the sidewalls to which the sidewall portions 19 and 21 are attached. This is the area of the sidewalls that defines the pocket in which the ball typically resides when it is carried by the player. The forward portions of sidewalls 18 and 20 leading to scoop 16 define the forward end of the head in which the ball is released when it is thrown, and many times in which the ball is received when it is caught.

Figure 2B:
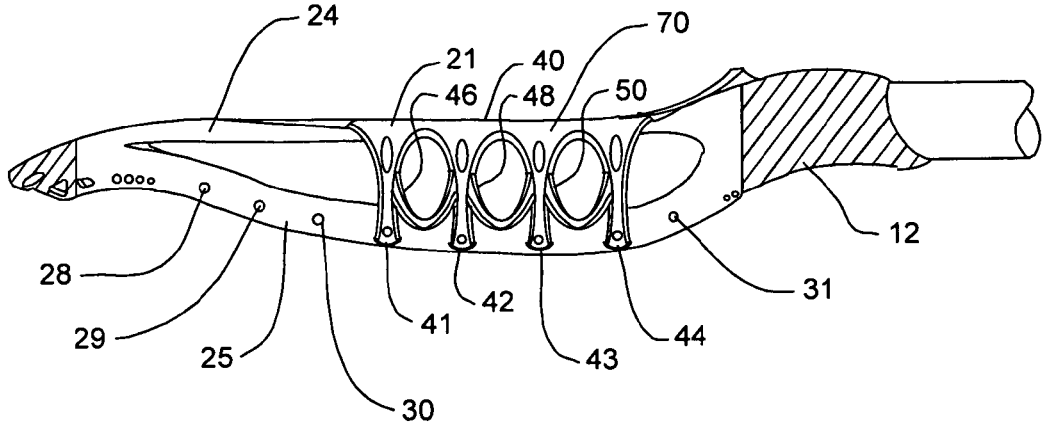
FIG. 2B is a longitudinal cross sectional view of the lacrosse head of FIG. 1.
Figure 3A:
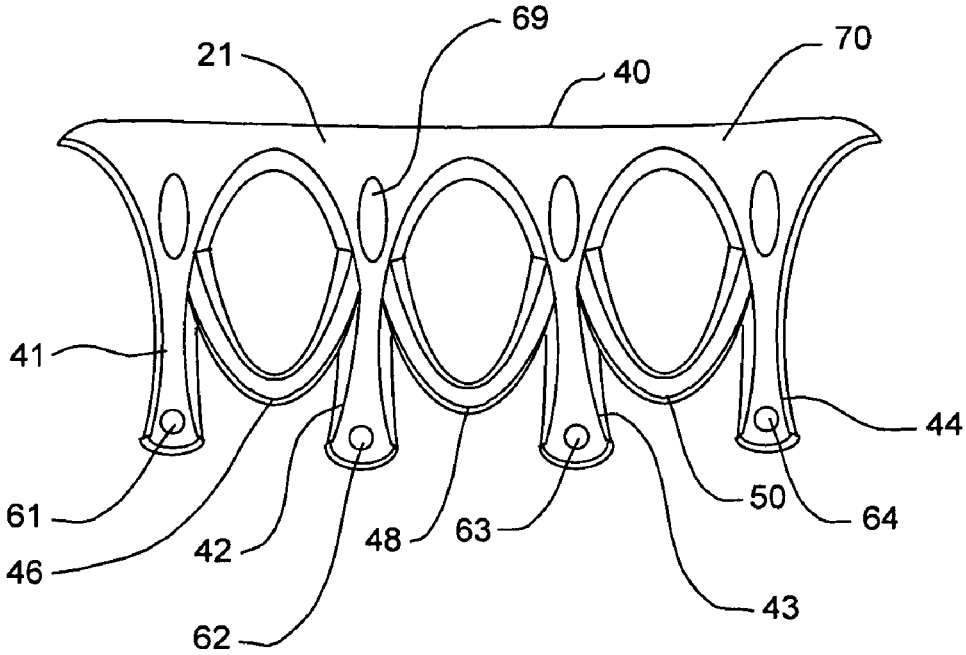
FIG. 3A is an interior side view of the right side softer sidewall insert of the lacrosse head of FIG. 1.
Figure 3B:
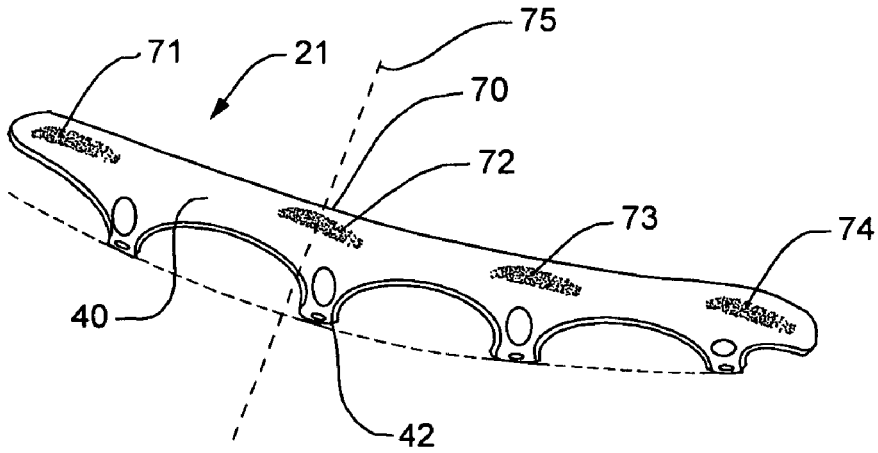
FIG. 3B is a top view of the sidewall insert of FIG. 3A.

As can be best seen in the cross sectional view of FIG. 2B, stringing openings 41–44 are designed to generally fall in line with openings 28–31 in sidewall 20. This allows the pocket portion of the stringing to be attached to softer sidewall portion 21. Since inside surface 70 of portion 21 extends inward toward opposite sidewall 18, the sidewall portions 19 and 21 effectively narrow the pocket portion of the stringing. However, since members 19 and 21 are soft and flexible, they are relatively easily pushed up against the sidewalls upon impact by a lacrosse ball. The result is that these inserts do not substantially narrow the open area of the pocket portion of the lacrosse head. Additionally, since these softer portions cover most of the top rim and effectively the entire inside surface of the sidewalls in the pocket area of the sidewalls, they substantially decrease ricochet from the narrowed portion of the lacrosse head in which a ball is more likely to contact a sidewall as it enters the head.

Stringing the pocket from softer sidewall portions 19 and 21 also provides some side-to-side movement or flex to the pocket. This allows for side-to-side ball motion within the head that can occur when a player is moving or the player's stick is checked, while still maintaining contact of the ball in the netting. In other words, the ball is less likely to move around in the pocket; rather the pocket itself can move. This maximizes a player's control of the ball in these circumstances.

Sidewall portions 19 and 21 in this preferred embodiment are attached to the frame by mechanical means. The preferred means is with upper extension portions such as portion 65, FIG. 4, that is attached to attachment member 72 that lies in opening 33 of upper sidewall rim 24. Portion 65 is pulled through opening 67 until enlarged head 66 lies on the lower side of rail 24. Enlarged head 66 inhibits member 72 from being pulled back up out of opening 67. Portion 65 can then be cut off if desired. Portion 80 is the area of contact with lower rail 25. The angle where portions 46 and 42 meet defines an angle as shown. This projects portion 42 inwards toward the other sidewall, effectively narrowing the pocket as described above. Portions 46, 48 and 50 also have a lot of give, thus they act as shock absorbers when a ball is received or moves around in the pocket, making catching and ball retention easier.

Sidewall insert 19 is shown in use in a strung lacrosse head in FIG. 5. Stringing holes 89–92 are defined in the lower portion of member 19 just as described above for member 21. Sidewall string 82 is passed through stringing holes 86–88 in sidewall 18, and through holes 89–92 of member 19, and around the peripheral portion of netting 83 just as with standard lacrosse head stringing. The difference in this embodiment is that the netting 83 is attached to member 19 rather than sidewall 18 along the length of the sidewall spanned by member 19.

Figure 6A:
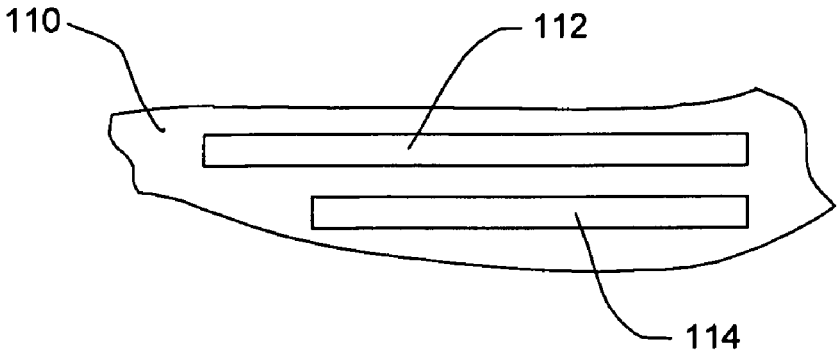
FIG. 6A is a side view, and FIG. 6B a top view, of the interior of part of a sidewall of another embodiment, showing partial inserts of the invention.
Figure 6B:
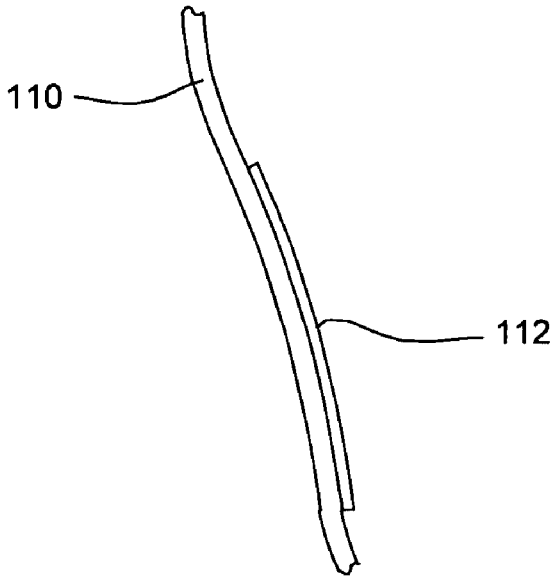

The preferred embodiment is not a limitation of the scope of the invention. There are numerous other embodiments that are within such scope. For example, the portion of the sidewall that comprises a softer material could be located only along the upper rim, or only along the interior walls of the sidewall portions. For example, sidewall 110, FIG. 6A, has inserts 112 and 114 that are embedded into sidewall 110. Inserts 112 and 114 are of a softer material than the material sidewall 110 so that the energy of the ball is damped as it impacts portion 112 and/or portion 114. These portions could project slightly inward from the sidewall as shown in FIG. 6B to better accomplish this damping. This type of construction could be accomplished by any of the mentioned attachment means. Note that these illustrations also show that the one or more softer sidewall portions in the head can be located where desired along some or all of the inside surface and/or upper rim of the sidewalls or of other portions of the lacrosse head to achieve a desired damping action. Also, the softer material could comprise more or less of the length of the sidewalls. In addition, the softer material can comprise some or all of the rearward wall or stop portion of the lacrosse head in addition to or as an alternative to the sidewall portions. The softer members can be placed where it is desirable to decrease ricochet from the head.

Other alternatives encompass different manners of coupling the softer portion or portions to the harder integral molded head. As briefly described above, one alternative is insert molding. In this case, the softer material inserts could be made first and placed in the mold into which the harder material is injected. This could encapsulate the softer portions or overlay them sufficiently so that they are held in place mechanically by the insert molding. Additionally, it would be possible to achieve these results with materials that were more physically coupled during the insert molding process, for example by materials that would partially intermingle during the insert molding process so that there was a stronger bond between the insert and the rest of the head. Yet another alternative is adhesives or mechanical fasteners or any other means of coupling the softer insert or inserts to the harder head frame.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A lacrosse head construction, comprising, a frame comprising a forward scoop having a width, a rearward wall more narrow than the scoop width, and two opposing sidewalls between the scoop and the rearward wall, wherein the scoop, rearward wall and a portion of each sidewall comprise an integral frame member;

pocket netting;

a plurality of pocket extension members that are fixed to said sidewalls so that said extension members are able to resiliently move independent of said sidewalls, wherein the extension members comprise partial sidewall inserts, wherein the inserts are mechanically coupled to the integral frame member;

a means for attaching said pocket netting to said pocket extension members; and wherein the frame member defines a plurality of connection openings along the top and bottom of the frame member sidewalls, and portions of each sidewall insert are held in these openings, to mechanically couple the inserts to the frame member.

2. The lacrosse head construction of claim 1, wherein the frame member sidewalls comprise spaced top and bottom rails, and the inserts are coupled to one or both rails.

3. A lacrosse head construction, comprising, an integral frame member comprising a forward scoop having a width, a rearward wall more narrow than the scoop width, and two opposing horizontal sidewalls between the scoop and the rearward wall, wherein the frame sidewalls each define an upper rim;

pocket netting;

a plurality of pocket extension members that are fixed to said sidewalls so that said extension members are able to resiliently move independent of, and substantially vertical to, said sidewalls; and a means for attaching said pocket netting to said pocket extension members, wherein the frame sidewalls each further define inside surfaces, and wherein the extension members are also at least along a portion of the sidewalls' inside surfaces.

4. A lacrosse head construction, comprising, an integral frame member comprising a forward scoop having a width, a rearward wall more narrow than the scoop width, and two opposing horizontal sidewalls between the scoop and the rearward wall, wherein the frame sidewalls each define an upper rim;

pocket netting;

a plurality of pocket extension members that are fixed to said sidewalls so that said extension members are able to resiliently move independent of, and substantially vertical to, said sidewalls; and a means for attaching said pocket netting to said pocket extension members, wherein the frame defines a plurality of stringing holes, and the means for attaching define one or more stringing holes.

5. A lacrosse head construction, comprising, an integral frame member comprising a forward scoop having a width, a rearward wall more narrow than the scoop width, and two opposing horizontal sidewalls between the scoop and the rearward wall, wherein the frame sidewalls each define an upper rim;

pocket netting;

a plurality of pocket extension members that are fixed to said sidewalls so that said extension members are able to resiliently move independent of, and substantially vertical to, said sidewalls; and a means for attaching said pocket netting to said pocket extension members, wherein the extension members project inward from the sidewalls, to lessen the distance between the sidewalls.

6. A lacrosse head construction, comprising, an integral frame member comprising a forward scoop having a width, a rearward wall more narrow than the scoop width, and two opposing horizontal sidewalls between the scoop and the rearward wall;

pocket netting;

a plurality of pocket extension members that are fixed to said sidewalls so that said extension members are able to resiliently move independent of, and substantially vertical to, said sidewalls; and a means for attaching said pocket netting to said pocket extension members;

wherein the frame sidewalls each define an upper rim, and wherein the extension members are at least along a portion of the sidewalls' upper rim; and wherein the frame sidewalls each further define inside surfaces, and wherein the extension members are also at least along a portion of the sidewalls' inside surfaces.

7. A lacrosse head construction, comprising, an integral frame member comprising a forward scoop having a width, a rearward wall more narrow than the scoop width, and two opposing horizontal sidewalls between the scoop and the rearward wall;

pocket netting;

a plurality of pocket extension members that are fixed to said sidewalls so that said extension members are able to resiliently move independent of, and substantially vertical to, said sidewalls; and a means for attaching said pocket netting to said pocket extension members;

wherein the frame sidewalls each define an upper rim, and wherein the extension members are at least along a portion of the sidewalls' upper rim, and wherein the frame defines a plurality of stringing holes, and the means for attaching define one or more stringing holes.

* * * * *